US005256934A

United States Patent [19]

Van Engelshoven et al.

[11] Patent Number: 5,256,934

[45] Date of Patent: Oct. 26, 1993

[54] DISPLAY TUBE COMPRISING AN ELECTRON GUN WITH A RESISTIVE FOCUSING LENS

[75] Inventors: Jeroen Van Engelshoven; Ger-Wim J. Goorhuis; Gerardus J. A. Hellings; Gerardus A. H. M. Vrijssen; Tjerk G. Spanjer, all of Eindhoven, Netherlands

[73] Assignee: U.S. Philips Corporation, New York, N.Y.

[21] Appl. No.: 883,819

[22] Filed: May 13, 1992

Related U.S. Application Data

[63] Continuation of Ser. No. 651,898, Feb. 6, 1991, abandoned.

[30] Foreign Application Priority Data

Feb. 14, 1990 [NL] Netherlands ..... 9000349

[51] Int. Cl.[5] ..... H01J 29/62

[52] U.S. Cl. ..... 313/450

[58] Field of Search ..... 313/450, 414

[56] References Cited

U.S. PATENT DOCUMENTS

| | | | |
|---|---|---|---|
| 3,143,681 | 8/1964 | Schlesinger | 313/450 |
| 3,286,114 | 9/1966 | Schlesinger | 313/450 |
| 3,327,160 | 6/1967 | Schlesinger | 313/450 X |
| 4,853,589 | 8/1989 | Vrijssen | 313/450 |
| 4,961,022 | 10/1990 | Hellings et al. | 313/414 |
| 4,988,928 | 1/1991 | Vrijssen et al. | 313/414 |
| 5,015,925 | 5/1991 | Spanjer et al. | 313/450 |

*Primary Examiner*—Palmer C. DeMeo
*Attorney, Agent, or Firm*—Robert J. Kraus

[57] ABSTRACT

Picture display device comprising a display tube with an electron gun having a hollow tubular structure with an inner surface on which a resistance structure of a material having a high electrical resistance is provided, which structure constitutes a focusing lens. The resistance structure is connected to at least two axially spaced electric contacts for connecting an anode voltage and at least one electric contact located in between for applying a focusing voltage. An electrode means of low-ohmic material for controlling the focusing lens by means of a dynamic correction signal is arranged in the region of the connection for the focusing voltage. Upon energization, the low-ohmic electrode means particularly exercises a non-rotationally symmetrical effect on the electron beam.

27 Claims, 4 Drawing Sheets

DISPLAY TUBE COMPRISING AN ELECTRON GUN WITH A RESISTIVE FOCUSING LENS

This is a continuation of application Ser. No. 07/651,898, filed Feb. 6, 1991, now abandoned.

BACKGROUND OF THE INVENTION

The invention relates to a picture display device comprising a display tube having a display screen and an electron gun arranged opposite said screen, with a cathode centred along an electron-optical axis and a plurality of electrodes which jointly constitute an electron beam-producing part, said gun further comprising a tubular structure having an outer surface and an inner surface on which a resistance structure of a material having a high electrical resistance is provided, which structure constitutes a focusing lens.

Lately, research efforts have been made regarding the use of a main focusing lens constituted by a (particularly helical) high-ohmic resistance structure in display tubes in order to obtain a low spherical aberration. The resistance structure has at least one contact for supplying a static focusing voltage and at least one contact for supplying an anode voltage.

However, when a dynamic correction signal together with the static focusing signal is to be supplied, the desired effect which was to be expected on grounds of previous experiences with conventional focusing tubes does not occur, particularly not at scan frequencies exceeding 16 kHz. (Correction by applying a dynamic focusing voltage may be necessary, for example in the case of large deflection angles so as to keep the electron beam in focus throughout the screen. In the corners a focusing voltage is required which is different from that in the centre of the screen. This means that the dynamic focusing voltage is a signal varying with the scan frequency whose intensity is a function of the position of the electron beam spot on the screen.)

SUMMARY OF THE INVENTION

It is an object of the invention to provide a picture display device comprising a display tube with an electrostatic lens, such as a focusing lens, of the helical resistance type, which is particularly suitable for using dynamic correction signals.

To this end a picture display device according to the invention is characterized in that the resistance structure has at least two electric contacts which are axially spaced apart and are adapted to be connected to first voltage-providing means for applying an anode voltage and is electrically connected to a low-ohmic electrode means arranged between said electric contacts, which means is adapted to be connected to second voltage-providing means for applying a static focusing voltage and a dynamic correction voltage. The low-ohmic electrode means may consist of one or more discrete metal components or of an electrically conducting layer.

The invention is based, inter alia, on the recognition that the high resistance of the (helical) lens structure leads to a long intrinsic RC time of the resistance layer, even at those locations where the layer does not form a helical structure but is homogeneous. In other words, the focusing signal does not propagate or hardly propagates in the resistance structure.

An essential aspect of the invention is that the electrical connection of the high-ohmic resistance structure to the above-described low-ohmic electrode means provides a region having an RC time which is decreased to such an extent that the dynamic correction signal can spread sufficiently far across the main focusing lens in the central part of the focusing lens. As will be described in greater detail, the intermediate electrode means may consist of, for example a coaxial metal ring, one or more transversal metal plates having a beam-passing aperture or of a thin conducting layer provided on the inner wall of the tubular structure and/or on the inner surface of the resistance structure. Vapour deposition, sputtering or painting are examples of suitable techniques for providing the thin conducting layer. It appears that dynamic correction signals (such as, for example dynamic focusing signals) having frequencies up to the MHz range now provide the desired effect.

A construction enabling the low-ohmic intermediate electrode to be provided in a simple manner is characterized in that the tubular structure comprises at least two aligned sub-tubes each having resistance structures which jointly constitute a main focusing lens and in that the low-ohmic electrode means consists of at least one metal plate having a beam-passing aperture, which plate is arranged transversely between the facing ends of the sub-tubes.

An embodiment of this construction is characterized in that the beam-producing part comprises a correction means for correcting possible alignment errors of the sub-tubes.

An alternative construction with which alignment errors are obviated is characterized in that the tubular structure comprises a single tube having a resistance structure provided on its inner surface, which structure constitutes a focusing lens, in that an annular structure of electrically conducting material making electrical contact with the resistance structure is arranged within said tube, which annular structure constitutes the low-ohmic electrode means, and in that the annular structure is connected to an electric contact via an aperture in the wall of the tube.

For dynamic focusing the low-ohmic intermediate electrode is constructed to exercise a rotationally symmetrical effect on the electron beam.

For dynamic and astigmatic focusing the low-ohmic intermediate electrode should be constructed to exercise a non-rotationally symmetrical effect.

BRIEF DESCRIPTION OF THE DRAWING

Some embodiments of a picture display device according to the invention will now be described in greater detail with reference to the drawing in which.

DESCRIPTION OF THE PREFERRED EMBODIMENTS

Figure 1:
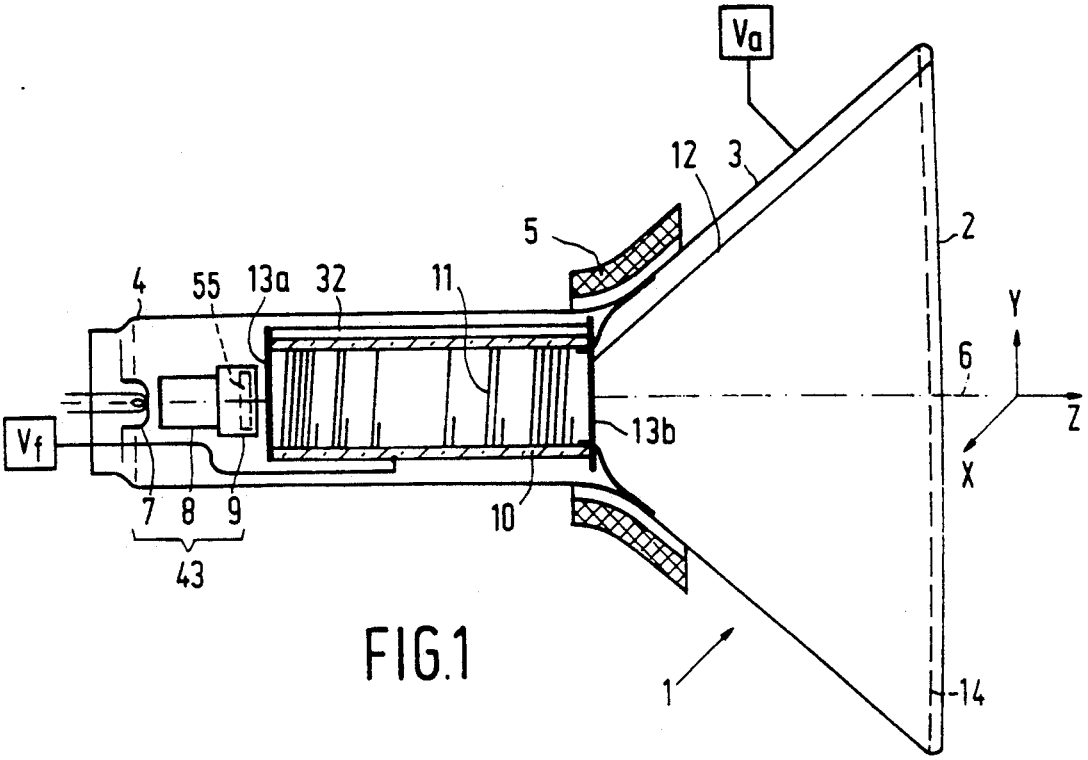
FIG. 1 shows diagrammatically a cross-section of a picture display device comprising a display tube according to the invention.

The device shown in FIG. 1 comprises a cathode ray tube consisting of, inter alia, a glass envelope 1 which is composed of a display window 2, a conical portion 3 and a neck 4. This neck accommodates electrode structures 8 and 9 which together with a cathode constitute the beam-producing part 43 of an electron gun. The electron-optical axis 6 of the electron gun is also the axis of the envelope. An electron beam 12 is successively formed and accelerated by the cathode 7 and the electrode structures 8, 9. The reference numeral 10 denotes a tubular structure whose inner surface carries a (particularly helical) structure 11 of a material having a very high electrical resistance which forms a focusing lens for focusing the beam on a display screen 14 on the inner side of the display window 2. The resistance structure 11 is electrically connected to a low-ohmic metal input electrode 13*a* and a low-ohmic metal output electrode 13*b*. In the case of a so-called unipotential lens suitable voltages to be applied to the electrodes are, for example:

| | |
|---|---|
| cathode 7 = | several tens of Volts (for example 50 V); |
| electrode 8 = | 0 V; |
| electrode 9 = | several hundreds of Volts (for example 400 V); |

input and output focusing lens = several tens of kilovolts (for example 30 kV) central part focusing lens = several kilovolts (for example 5 kV). The electron beam 12 is deflected by means of a system 5 of deflection coils from the axis 6 across the display screen 14. Display screen 14 consists of a phosphor layer which is coated with a thin aluminium film which is electrically connected to the end of electrode 11 via a conducting coating on the inner wall of the conical portion 3.

For applying a focusing voltage in the central part of the focusing lens a low-ohmic electrode is required within the scope of the invention. This electrode may be constructed in different manners. Examples will be given with reference to FIGS. 5, 6, 7 and 8.

Figure 2:
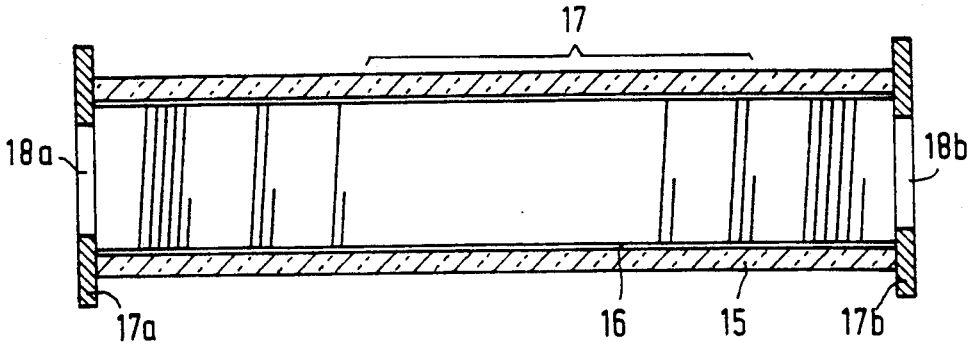
FIG. 2 is an elevational view of a longitudinal cross-section through a part of a focusing lens of an electron gun suitable for use in the display tube of FIG. 1.

Some details of the construction of a focusing lens of a type suitable for use in an electron gun of the display tube of FIG. 1 will be described with reference to FIG. 2. The type in question comprises a tubular (glass) envelope 15. The inner side of the envelope 15 whose ends are provided with transversal metal electrode plates 17*a*, 17*b* having central coaxial apertures 18*a*, 18*b* carries a high-ohmic resistance layer 16 in which a helical structure is formed which constitutes a focusing lens 17 when a suitable electric voltage is applied. The patterns of parallel oblique lines diagrammatically represent the locations where the resistance layer 16 has been omitted. The parts of the helical structure are thus always present between two of these lines. The high-ohmic resistance layer 16 may consist of, for example glass enamel having a small amount (for example several % by weight) of metal oxide (particularly ruthenium oxide) particles. The layer 16 may have a thickness of between 1 and 10 νm, for example 3 νm. The resistance per square of such a layer depends on the concentration of metal oxide and the heat treatment to which the layer is subjected. In practice resistances per square varying between $10^4$ and $10^8$ Ω have been realised. A desired resistance per square can be realised by adjusting the relevant parameters. A resistance per square of the order of $10^6$ Ω is very suitable for the relevant application. The total resistance of the helical structure formed in the layer 16, which structure may comprise a continuous helix as well as a number of separate helixes connected by segments without a helical structure (6 in the example of FIG. 2), may be of the order of 10 G Ω. This means that a current of several mA will flow across the ends at a voltage difference of 30 kV. In this Figure and in all other Figures the (oblique) line patterns indicate the locations of the resistance layer where the material has been removed from the resistance layer by means of, for example, a rotating cutting tool.

The electron gun of FIG. 1 has a beam-producing part 43 preceding the focusing lens 17, which part generally comprises a cathode 7, a grid electrode 8 and an anode 9. In the case of FIG. 1 the components of the beam-producing part 43 are separately mounted in the display tube, for example, by means of axial glass-ceramic mounting rods. Alternatively, they may be mounted within the tubular envelope 10 of the focusing lens.

It may be necessary to correct occurring picture errors by means of dynamic focusing. The power of the electron lens for focusing the electron beam is adjusted as a function of the deflection to which the electron beam is subjected at that instant. This provides the possibility of causing the main picture plane which is then prevalent to intersect the display screen at the location where the electron beam impinges upon the display screen. This correction mode requires an extra circuit in the control device for generating the correct dynamic focusing voltages on the electrodes of the focusing lens.

Since the material of the helical resistance structure has such a high electrical resistance (for example 10 G Ω), the RC time is long (for example 10 msec). As a result, the effect of a dynamic focusing voltage applied to electrode 17*a* will hardly reach the helical resistance structure. The invention provides a solution in this respect. The principle of this solution will be elucidated with reference to FIGS. 3 and 4 showing two designs of focusing lenses which are suitable for use in an electron gun for a picture display device according to the invention.

Only two electric supply leads are required for the two types of focusing lenses: an anode lead and a focus lead.

Figure 3:
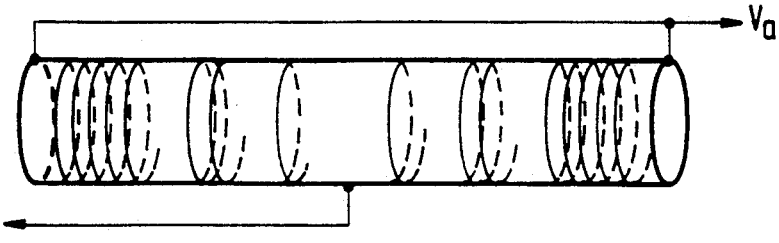
FIG. 3 shows a basic diagram of a first embodiment of a focusing lens which can be used in an electron gun.

FIG. 3 shows diagrammatically a helical focusing lens in which an anode voltage $V_a$ is applied to the ends and a focusing voltage $V_f$ is applied to the central part (so-called unipotential lens). A characteristic feature of a unipotential lens design is that, in contrast to a bipotential lens design, the voltages across the object-sided lens portion and the image-sided lens portion are equal. The resistance structures of these two portions may be symmetrical. Each structure has, for example 5 helical segments.

Figure 4:
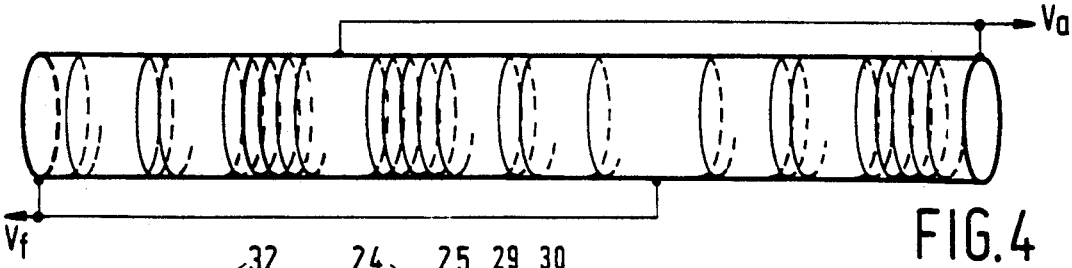
FIG. 4 shows a basic diagram of a second embodiment of a focusing lens which can be used in an electron gun.

FIG. 4 shows diagrammatically a helical focusing lens in which an anode voltage $V_a$ is applied to one end and to a first part located between the ends, and a focusing voltage $V_f$ is applied to the other end and to a second part located between the ends (so-called quadripotential lens).

Such a lens may have an object-sided potential at the focusing voltage, followed by a trajectory where the potential increases to the anode voltage and then the potential may decrease to the focusing voltage and increase again to the anode voltage on the last trajectory.

Other types of "multipotential" lenses are also applicable.

The voltages can be applied, for example by making an aperture in the wall of the glass tube at each desired location, which glass tube carries the resistance structure on its inner surface, and by providing an electric contact in this aperture (for example an indium pellet) which makes contact with the resistance layer. Instead of this type of electric contact a metal flange making electrical contact with the resistance layer can be provided at the ends of the glass tube.

However, within the scope of the invention, the electrode for applying a dynamic correction signal should always be a low-ohmic intermediate electrode electrically connected to the resistance layer.

Figure 5:
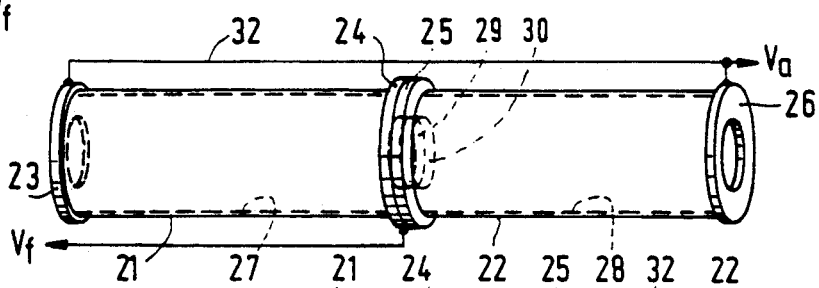
FIGS. 5, 6 and 7 show realisations of the basic diagram of FIG. 3.

An embodiment of the lens design of FIG. 3 is shown in FIG. 5. The resistance lens construction shown in this Figure comprises a sub-tube 21 and a sub-tube 22. Metal flanges (for example flanges of CrFe) 23, 24 each having a coaxial aperture are sealed to the ends of sub-tube 21 and metal flanges 25, 26 each having a coaxial aperture are sealed to the ends of the sub-tube 22. The flanges 23, 26 serve for applying the anode voltage $V_a$. In the manner described with reference to FIG. 2 high-ohmic resistance layers 27, 28 having a helical structure are arranged in the sub-tubes 21, 22. The flanges 24, 25, each of which has a beam-passing aperture, are welded together and jointly constitute a low-ohmic intermediate electrode which serves for applying the (static+dynamic) focusing voltage $V_f$.

Figure 6:
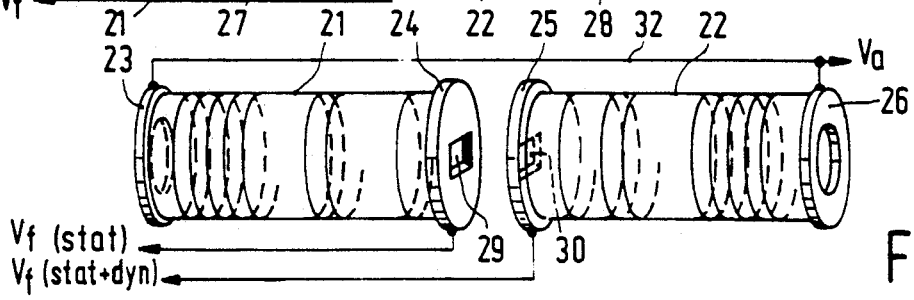

FIG. 6 shows a substantially identical structure. However, in this case the facing flanges 24, 25 are not welded together, but arranged in a mutually electrically insulated manner (for example, by mounting on glass or ceramic rods which are not shown). This provides the possibility of applying a static plus a dynamic focusing voltage $V_f$(stat+dyn) to, for example flange 25 and a static focusing voltage $V_f$ (stat) to flange 24. In the constructions shown in FIGS. 5 and 6 the metal flanges 24, 25 having coaxial central apertures 29, 30 function as low-ohmic electrodes. The apertures 29, 30 may have a rotationally symmetrical shape, as in FIG. 5. If the apertures 29, 30 have a non-rotationally symmetrical shape, for example a square or elongate (oval or rectangular) shape, as in FIG. 6, an electric 4-pole field forming an astigmatic lens is formed in between them upon energization. The applied dynamic focusing voltage has a diverging effect on an electron beam passing through the focusing lens, both in the horizontal and in the vertical direction. This diverging effect can be compensated in the horizontal direction and increased in the vertical direction by the astigmatic lens which is formed between the flanges 24, 25 when the dynamic and static focusing voltages are applied. This renders an independent horizontal and vertical focusing possible, which is particularly important in color display tubes. (Here, dynamic astigmatic focusing is concerned).

Figure 7:
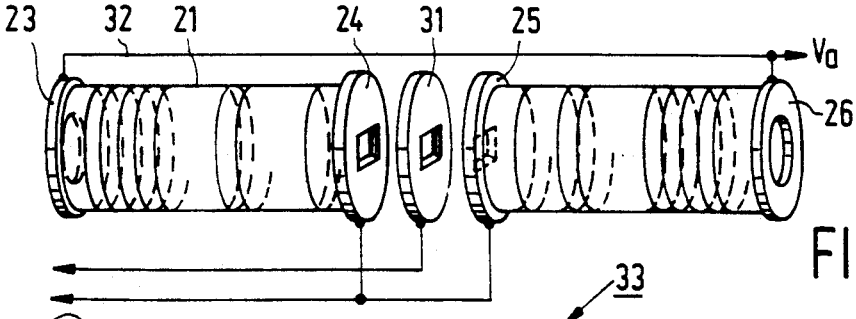

FIG. 7 shows a structure which is substantially identical to the structure of the focusing lens of FIG. 6. In this case, however, an extra transversal electrode 31 is arranged between the flanges 24 and 25. The required static and dynamic focusing voltages can now be separately applied to the electrodes 24, 25 and 31.

Figure 9:
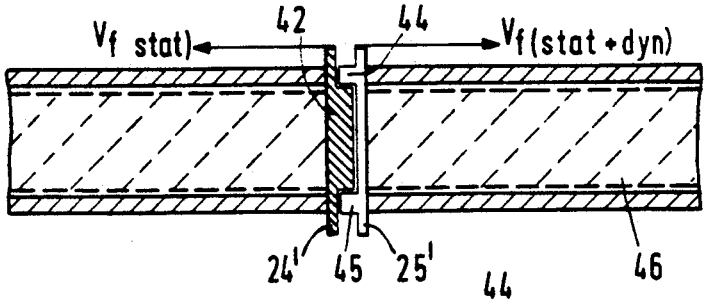
FIG. 9 is a longitudinal section of a part of a focusing lens having an electrode means which exercises a non-rotationally symmetrical effect.
Figure 9A:
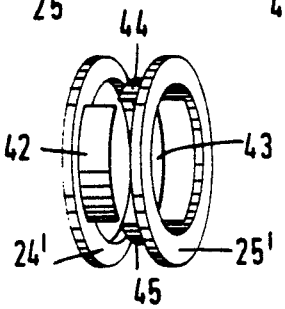
FIG. 9*a* is a detailed illustration of the two flanges shown in FIG. 9.

FIG. 9 shows a part of a focusing lens construction with a low-ohmic electrode means comprising two metal flanges 24' and 25' each having a beam-passing aperture and engaging projections 42, 43, 44 and 45 whereby, upon energization, a 4-pole field is generated between the flanges. These flanges are illustrated in more detail in FIG. 9*a*.

In the cases of FIGS. 5, 6, 7 and 9 the focusing lens always comprises at least two sub-tubes having a resistance structure. This could give rise to misalignment of the sub-tubes. Possibly occurring misalignments can be corrected by a correction means particularly arranged in front of the focusing lens. The desired correction is realised, for example, by providing a ring 55 of permanently magnetizable material in the last electrode of the beam-producing part of the electron gun (electrode 9 in FIG. 1) and by magnetizing this ring from the exterior after the electron gun has been mounted in the display tube. It appears from FIGS. 5, 6 and 7 that the metal flanges 24, 25 (and 31) are comparatively close to the through-connection wire 32 applying the anode (high) voltage to flange 23. Since the flanges 24, 25 (and 31) convey the (lower) focusing voltage, this may give rise to unwanted field emission ("spraying") of the flanges 24, 25 (and 31) to the through-connection wire 32, particularly when the flanges are rough (or have projections). To prevent this, it should be ensured that the components conveying different voltages do not "see" one another, for example, by insulating the connection wire by oxidizing the material of which it is made or by coating it with an insulating layer. However, an electrically insulating protective coating is preferably provided on the components conveying the lowest voltage (i.e. the flanges 24, 25 (and 31)). A thin layer of ceramic material or of glass is suitable for insulation. In the latter case, for example aluminium phosphate glass is a good choice. This may be provided in a thin layer and has a high viscosity already at a relatively low temperature. Consequently, a great degree of freedom with respect to the coefficients of expansion of the metal to be coated and the glass is admissible. Also in the case of the relatively high viscosity and a small thickness (of the order of microns) of the layer, this layer will easily follow possible irregularities of the surface on which it is provided and thus coat this surface satisfactorily. An alternative example is to manufacture the flanges 24, 25 (and 31) from a chromium-containing material and to subject it to an oxidation treatment.

Figure 8:
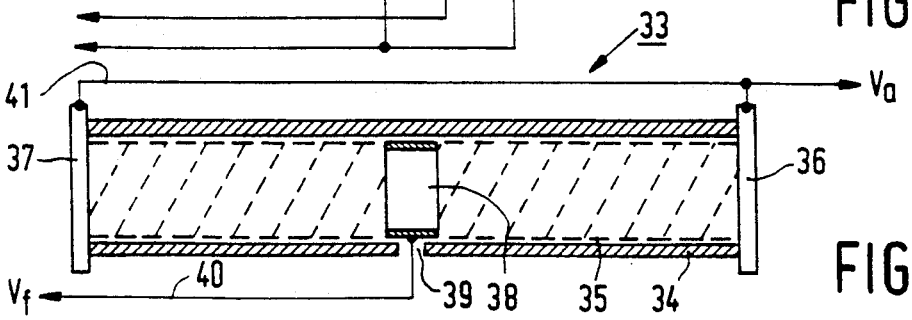
FIG. 8 shows an alternative realisation of the basic diagram of FIG. 3.

Another way of preventing the occurrence of unwanted field emission is explained with reference to FIG. 8.

Instead of two (or more) sub-tubes (for example two tubes having a length of 35 mm each) the focusing lens 33 comprises one single tube 34 (having a length of, for example 70 mm) in this case. The inner surface of tube 34 is provided, for example in the manner described hereinbefore with a high-ohmic resistance layer 35 having a helical pattern and its ends may be provided with flanges 36, 37 which are electrically connected thereto and are intended to apply an anode voltage $V_a$. The tube 34 accommodates a coaxial metal ring 38 (for example of CrNi) which is in (clamping) engagement and in electrical contact with a part of the resistance layer 35 in which no helical pattern has been provided. Focus lead 40 is welded (for example by means of laser welding) to the clamping ring 38 functioning as a focusing electrode via an aperture 39 (of, for example 1.5×3 mm) in the wall of the tube 34, which aperture is made (for example by means of sandblasting) preferably after the resistance layer 35 is provided. In this construction the wall of the tube 34 shields the focusing electrode 38 from anode through-connection wire 41, thus preventing the above-mentioned field emission problem. The width of the focusing electrode (clamping ring 38 in this case) determines to a considerable extent the region where dynamic focusing takes place. Also the width of the uninterrupted part of the resistance layer 35 located between the helical portions plays a role if this width deviates from the width of the focusing electrode. Static focusing takes place throughout the length of the helical pattern.

To prevent possible high-voltage problems, it is important that the focus lead 40 does not "see" the high-voltage through-connection wire 41. To achieve this, it is useful to provide the aperture 39 in a position which is rotated through an angle of between 120° and 180° with respect to the position of the wire 41.

In its simplest form the coaxial focusing ring 38 is rotationally symmetrical so as to render the use of dynamic focusing possible. Within the scope of the invention rotationally symmetrical rings are not only understood to mean (closed) rings whose circumference exactly follows a circular path, but also (open) substantially circular rings with two ends which slightly overlap or with two ends which are located opposite each other in one plane, either with the inclusion of a small gap or by means of a butt joint.

Instead of a discrete ring (38) a layer or a tape of electrically conducting (low-ohmic) material can be used as a focusing electrode. Such a layer can be provided on the inner wall of the tube 34 before the high-ohmic resistance structure 35 is provided. An alternative method is to provide the high-ohmic resistance structure 35 and to coat it with a layer of electrically conducting material, for example a layer of electrically conductive paint sold under the name of "Leitsilber".

As already noted hereinbefore, the invention can be used for dynamic astigmatic focusing, for which purpose an electric 4-pole field is generated in the focusing lens range. However, it may also be used for generating other dynamic multipole fields in the focusing lens range, for example, a dynamic dipole field (for beam displacement).

The inventive principle of ohmically coupling in a dynamic signal into a resistance lens may be used advantageously in a projection TV tube, but the principle may also be used in color display tubes. Another possibility is its use in oscilloscope tubes in which the high-frequency deflection could be effected, for example by means of a signal which is ohmically coupled in, similarly as the dynamic focusing signal.

Figure 10:
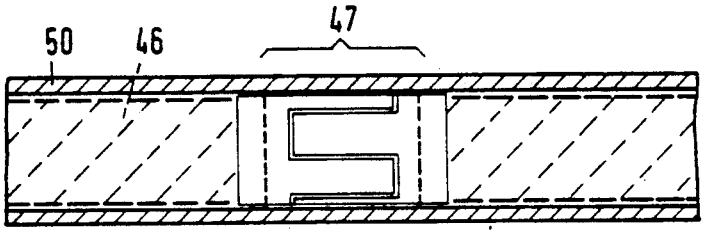
FIGS. 10, 11 and 12, 13 show alternatives to the construction shown in FIG. 9.
Figure 11:
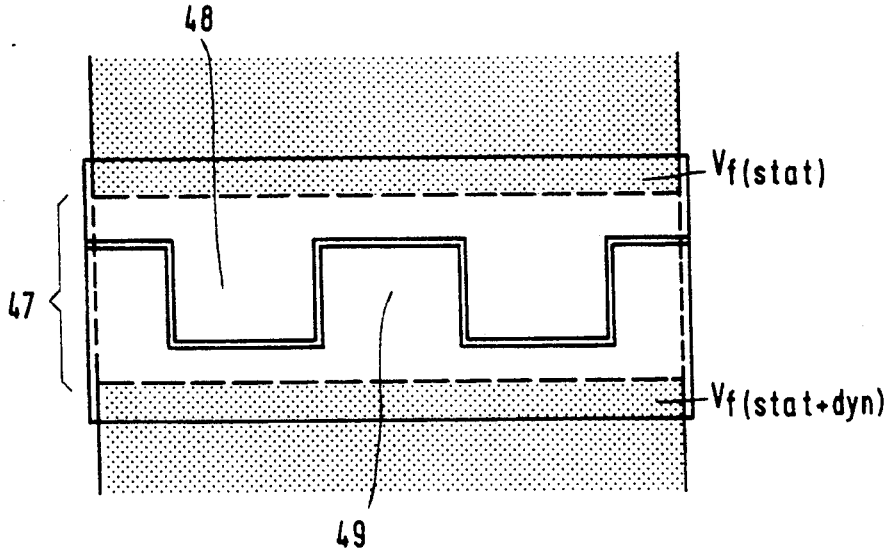

Dynamic astigmatic focusing may be carried out in manners differing from those described hereinbefore, for example, in the manner shown in FIG. 10. In this case the resistance layer 46 of the focusing lens is interrupted over an intermediate area 47 of several millimeters. In this area the inner wall of the tubular structure 50 carries two metal electrodes 48, 49 which have engaging projections of several millimeters' length. Each electrode 48, 49 slightly overlaps the resistance layer 46 so as to establish electrical contact therewith. The electrodes may be made of, for example, a layer of a low-ohmic material provided by way of an electroless or a vapour-deposition process, in which the finger structure is provided by means of etching or by a laser. The support may be a synthetic material foil. Electrodes of the type 24', 25' shown in FIG. 9 are alternatively possible. FIG. 11 shows the area 47 and its direct surroundings in greater detail. A voltage $V_f$(stat) is applied to the electrode 48 and a voltage $V_f$(stat+dyn) is applied to the electrode 49.

Figure 12:
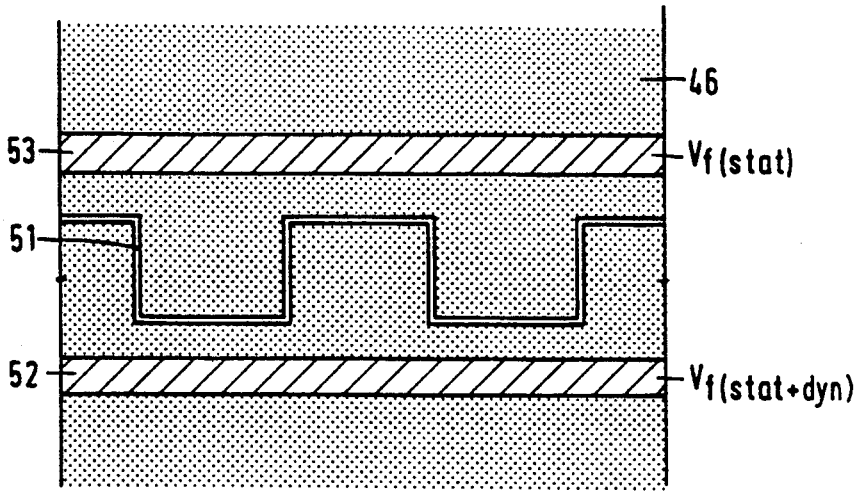

FIG. 12 shows a simpler solution. Here the resistance layer 46, in which the helical pattern is formed, is not interrupted over a given (intermediate) area (as in the constructions shown in FIGS. 5, 6, 7, 9, 10 and 11), but it continues as in the construction shown in FIG. 8. A finger structure is formed by means of a scratch 51 in the resistance layer 46. (There may be a plurality of parallel scratches so as to reduce the voltage drop per scratch.) An annular structure in the form of two tape-shaped metal electrodes 52, 53 is provided on both sides at a short distance (several mm) from this scratch. These electrodes are energized in the same way as the electrodes shown in FIG. 11. By making the distance between these tape-shaped electrodes and the ends of the fingers sufficiently small, it is possible for the DAF signal to enter into the ends of the fingers. This solution has the advantage that the accuracy is determined by the scratch in the resistance layer and is not determined by the position or the shape of the tape-shaped electrodes.

DAF is possible at the line frequency as well as at the field frequency, when the latter two solutions are employed. Another advantage is that DAF electrodes having a finger structure are very effective.

Figure 13:
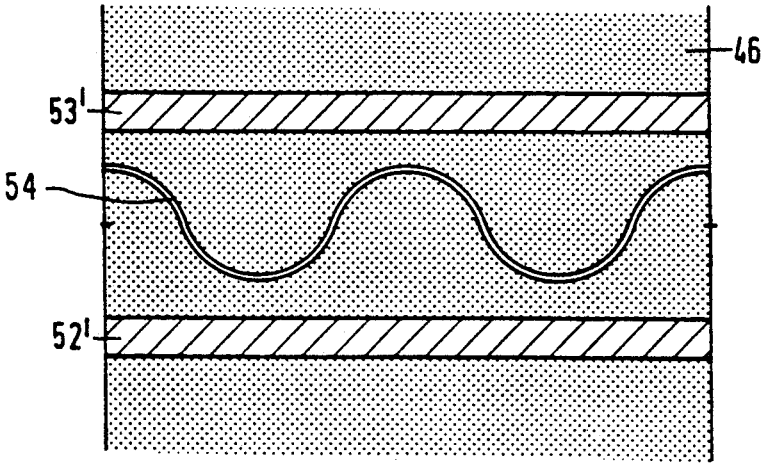

A further refinement (see FIG. 13) is to replace the rectangular finger (or square-wave) structure by a more gradual profile such as a sin 2Ω function. Such a scratch 54 is easier to provide and will result in fewer lens errors. Here, too, use is made of tape-shaped electrodes 52' and 53' to which respective voltages $V_f$(stat) and $V_f$(stat+dyn) are applied.

Figure 14:
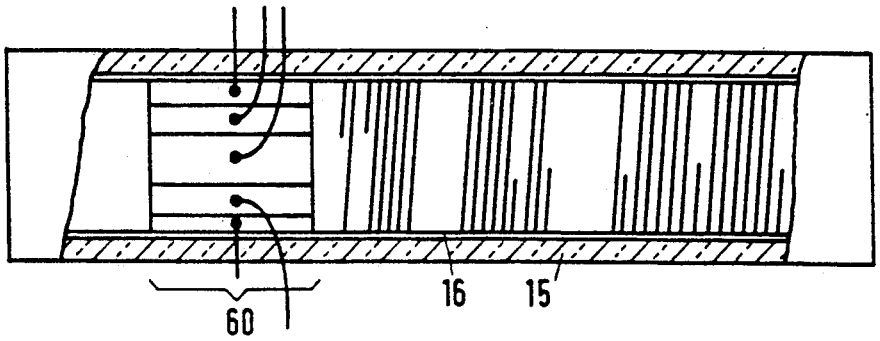
FIG. 14 shows an alternative use of the invention.

The invention is generally based on the recognition that the high resistance of the resistance structure leads to a long intrinsic RC time, even at those locations where the layer does not form a helical structure, so that a H.F. correction signal, such as a dynamic focusing signal, does not enter or hardly enters into the resistance structure. This also holds in the case where a portion of the resistance structure outside the focusing lens portion constitutes a correction element. This may be a correction element of a type described hereinbefore, or a cylindrical element 60 which has a plurality of circumferentially arranged parts (for example, 2, 4 or 8), each of which is adapted to be connected to voltage-providing means for applying a correction voltage and each of which is in contact with a low-ohmic electrode means for decreasing its resistance (see FIG. 14). Each low-ohmic electrode means should at least be in contact with its own correction element part in the area of the voltage contact. If desired, the correction element parts can be electrically connected to the resistance structure portion constituting a focusing lens.

A further aspect of the invention thus is that contacting each individual portion of the high-ohmic correction element with a low-ohmic electrode means provides a region having an RC time which is decreased to such an extent that the dynamic correction signal can spread fast enough across the correction element to be effective. The low-ohmic electrode means may consist of, for example, a thin conducting layer provided on the inner wall of the tubular structure. Vapour deposition, sputtering or painting are examples of suitable techniques for providing the thin conducting layer. It appears that dynamic correction signals (such as, for example dynamic focusing signals) having frequencies up to the MHz range now provide the desired effect.

We claim:

1. A picture display device comprising a display tube having a display screen and an electron gun arranged on an electron-optical axis for producing an electron beam directed along said axis toward said screen, said electron gun comprising, arranged along said axis, an electron beam producing part for producing the electron beam and a tubular structure, through which the electron beam passes, for effecting focusing the electron beam to form a luminescent spot for deflection across the screen, characterized in that said tubular structure comprises:

a. at least one tubular member of insulating material having an inner surface bearing a resistive layer means forming a predetermined pattern for producing a focusing lens;

b. first conductive means electrically connected to axially spaced portions of said resistive layer means;

c. second conductive means electrically connected to a portion of said resistive layer means which is disposed between said axially spaced portions; and d. means for applying to said first and second conductive means respective voltages for effecting static and dynamic focusing of the electron beam.

2. A picture display device as in claim 1 where the pattern comprises a continuous helix.

3. A picture display device as in claim 1 where the pattern comprises a plurality of successive helixes.

4. A picture display device as in claim 1 where said means for applying the voltages comprises a first conductor for connection to a source of an anode voltage for the display tube and a second conductor for connection to a source of static and dynamic focusing voltages.

5. A picture display device as in claim 4 where the first conductor is electrically connected to the first conductive means and where the second conductor is electrically connected to the second conductive means.

6. A picture display device comprising a display tube having a display screen and an electron gun arranged on an electron-optical axis for producing an electron beam directed along said axis toward said screen, said electron gun comprising, arranged along said axis, an electron beam producing part for producing the electron beam and a tubular structure, through which the electron beam passes, for effecting focusing the electron beam to form a luminescent spot for deflection across the screen, characterized in that said tubular structure comprises:

a. first and second tubular members of insulating material, each having an inner surface bearing a resistive layer means forming a helical pattern, a first end adjacent a corresponding first end of the other tubular member, and a second end;

b. first conductive means attached to the first ends of the tubular members and electrically connected to respective ends of the resistive layer means in said tubular members;

c. second conductive means attached to the second end of the first tubular member and electrically connected to a respective end of the resistive layer means in said tubular member;

d. third conductive means attached to the second end of the second tubular member and electrically connected to a respective end of the resistive layer means in said tubular member;

e. fourth conductive means for electrically connecting the second and third conductive means; and f. means for applying to said first and fourth conductive means respective voltages for effecting static and dynamic focusing of the electron beam.

7. A picture display device as in claim 6 where the first, second and third conductive means comprise metallic plates having respective apertures through which said electron beam passes.

8. A picture display device as in claim 7 where the first conductive means comprises adjacent first and second apertured metallic plates which are conductively affixed to each other.

9. A picture display device as in claim 7 where the first conductive means comprises adjacent first and second apertured metallic plates which are electrically insulated from each other.

10. A picture display device as in claim 7 where the first conductive means comprises adjacent first, second and third apertured metallic plates which are electrically insulated from each other.

11. A picture display device as in claim 7 where the aperture in at least one of said metallic plates has a non-rotationally symmetrical shape for affecting focusing of the electron beam.

12. A picture display device as in claim 7 where the first conductive means comprises a metallic plate having a non-rotationally symmetrical shape for affecting focusing of the electron beam.

13. A picture display device as in claim 6 where the electron beam producing part includes means for correcting alignment errors of the first and second tubular members.

14. A picture display device comprising a display tube having a display screen and an electron gun arranged on an electron-optical axis for producing an electron beam directed along said axis toward said screen, said electron gun comprising, arranged along said axis, an electron beam producing part for producing the electron beam and a tubular structure, through which the electron beam passes, for effecting focusing the electron beam to form a luminescent spot for deflection across the screen, characterized in that said tubular structure comprises:

a. a continuous tubular member of insulating material having an inner surface bearing a resistive layer means forming a pattern for producing a focusing lens;

b. first conductive means electrically connected to axially spaced portions of said resistive layer means;

c. second conductive means electrically connected to a portion of said resistive layer means which is disposed between said axially spaced portions; and d. means for applying to said first and second conductive means respective voltages for effecting static and dynamic focusing of the electron beam.

15. A picture display device as in claim 14 where the second conductive means comprises a metallic member in contact with the resistive layer means.

16. A picture display device as in claim 15 where the metallic member comprises a rotationally symmetrical metal ring.

17. A picture display device as in claim 14 where the second conductive member comprises a layer of conductive material in contact with the resistive layer means.

18. A picture display device as in claim 17 where the layer of conductive material is disposed on an inner surface of the resistive layer means.

19. A picture display device as in claim 17 where the layer of conductive material is disposed between the inner surface of the tubular member and the resistive layer means.

20. A picture display device as in claim 15 or 17 where the pattern comprises first and second helixes separated by a continuous band of the resistive material which has a first predetermined width, and where the second conductive means is disposed on said band and has a second predetermined width.

21. A picture display device as in claim 20 where the first and second predetermined widths are substantially equal.

22. A picture display device as in claim 14 where the second conductive means comprises axially separated, interdigitated first and second electrodes.

23. A picture display device as in claim 22 where the resistive layer means comprises first and second resistive layers which are axially separated by an area of the inner surface of the continuous tubular member, said interdigitated first and second electrodes being disposed on said surface area in electrical contact with said first and second resistive layers.

24. A picture display device as in claim 14 where the resistive layer means comprises a resistive layer having an interruption in the form of a line of predetermined shape encircling said axis, and where the second conductive means comprises first and second electrodes disposed on opposite sides of said line in contact with respective portions of the resistive layer.

25. A picture display device as in claim 24 where said line has a square wave shape.

26. A picture display device as in claim 24 where said line has a sinusoidal shape.

27. A picture display device as in claim 14 where the means for applying said voltages to said first and second conductive means comprises a conductor electrically connected to the second conductive means via an aperture in said tubular member.

* * * * *

UNITED STATES PATENT AND TRADEMARK OFFICE

CERTIFICATE OF CORRECTION

PATENT NO. : 5,256,934
DATED : October 26, 1993
INVENTOR(S) : Kerpem Van Engelshoven, et. al.

It is certified that error appears in the above-indentified patent and that said Letters Patent is hereby corrected as shown below:

Column 10, Claim 12, line 30, change "7" to -- 11--.

Signed and Sealed this

Ninth Day of August, 1994

Bruce Lehman

*Attest:*

BRUCE LEHMAN

*Attesting Officer*

*Commissioner of Patents and Trademarks*